US007448235B2

(12) United States Patent
Ely et al.

(10) Patent No.: US 7,448,235 B2
(45) Date of Patent: Nov. 11, 2008

(54) METER BOX LOCKING ASSEMBLY

(75) Inventors: Timothy B. Ely, Fairfield, CT (US); Frederick P. Finck, Jr., Fairfield, CT (US)

(73) Assignee: Rexnord Industries, LLC, Milwaukee, WI (US)

( * ) Notice: Subject to any disclaimer, the term of this patent is extended or adjusted under 35 U.S.C. 154(b) by 771 days.

(21) Appl. No.: 10/778,430

(22) Filed: Feb. 16, 2004

(65) Prior Publication Data

US 2005/0178174 A1 Aug. 18, 2005

(51) Int. Cl.
*E05B 65/48* (2006.01)

(52) U.S. Cl. ..... 70/2; 70/34; 70/56; 70/63; 70/159; 70/164; 70/451; 70/466; 292/281; 292/340

(58) Field of Classification Search ..... 70/2, 70/6–14, 34, 54–56, 63, 158–173, 232, 370–371, 70/386, 451, 466; 292/281, 282, 286, 340, 292/DIG. 53; 248/551–553
See application file for complete search history.

(56) References Cited

U.S. PATENT DOCUMENTS 3,968,985 A 7/1976 Nielsen, Jr.
3,980,332 A * 9/1976 King, Sr. ..... 292/320
4,031,722 A * 6/1977 Michelman et al. ..... 70/63
4,049,313 A 9/1977 Lundberg
4,080,811 A * 3/1978 Nielsen, Jr. ..... 70/232
4,096,718 A * 6/1978 Michelman et al. ..... 70/63
4,107,959 A * 8/1978 Skarzynski et al. ..... 70/159
4,120,182 A 10/1978 Michelman et al.
4,144,729 A 3/1979 Nielsen, Jr.
4,152,910 A 5/1979 Swisher
4,254,647 A 3/1981 Finck, Jr.
4,289,000 A 9/1981 Nielsen, Jr.
4,414,829 A * 11/1983 Nielsen et al. ..... 70/160
4,474,041 A 10/1984 Finck, Jr.
4,475,365 A 10/1984 Swisher
4,551,999 A 11/1985 Guiler
4,733,893 A * 3/1988 Davis et al. ..... 292/320
4,751,831 A 6/1988 Morris, Jr. et al.
4,830,414 A 5/1989 Davis
5,007,258 A 4/1991 Mahaney (Continued)

*Primary Examiner*—Patricia Engle
*Assistant Examiner*—Christopher Boswell
(74) *Attorney, Agent, or Firm*—Quarles & Brady, LLP

(57) ABSTRACT

A locking assembly for locking a cover over an opening of an enclosure includes a mounting bracket including a first wall having opposing first and second ends, a second wall joined to said first end and extending in a first direction away from the first wall. A stud joined to the first wall extends in a second direction away from the first wall. Hooking structure extends from the second wall of the mounting bracket for extending into the opening of the enclosure and engaging the enclosure to secure the mounting bracket relative to the enclosure. A locking bracket includes a first wall having opposing first and second ends and a first surface facing the first wall of the mounting bracket. A second wall is joined to the first end of the mounting bracket and extends in a first direction away from the first wall of the locking bracket. In one embodiment, a lock housing is fixed to the first wall of the locking bracket. The lock housing defines a cavity for receiving a barrel lock and an opening intersecting said cavity. The opening receives the stud for engaging the barrel lock received in the cavity.

18 Claims, 7 Drawing Sheets

U.S. PATENT DOCUMENTS 5,267,688 A 12/1993 Benefield
5,315,849 A * 5/1994 Georgopoulos ..... 70/34
5,402,958 A * 4/1995 Mahaney ..... 242/388.1
5,544,506 A 8/1996 Nakano
5,870,911 A 2/1999 DeWatch
6,684,670 B1 2/2004 Agbay et al.
6,742,365 B1 * 6/2004 Sullivan et al. ..... 70/2

* cited by examiner

METER BOX LOCKING ASSEMBLY

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The invention relates to locking devices and is directed more particularly to a quickly installed locking assembly for use in conjunction with utility meter boxes and similar devices.

There is a growing need to secure electric meter boxes or other similar utility enclosures in order to prevent the theft of utility services. Theft of electricity by tampering with or bypassing the usual electric meter connections enclosed in such meter boxes is becoming more and more common, particularly since the cost of electricity has been rising rapidly. The losses in revenue experienced by utility companies due to theft have become very high. Further, it is desirable to secure the electric meter boxes because there is a great danger to those tampering with the electric meters inside, as current of potentially deadly magnitude is involved.

Accordingly, it has become increasingly important to take all possible steps to prevent the theft and attempted theft of electricity by securing meter boxes and locking devices have been proposed for this purpose. Examples of locking devices for electric meter boxes are found in U.S. Pat. Nos. 4,096,718 and 4,474,041. In these examples, a bracket is secured to the meter box using a screw that either extends through a hole drilled through the meter box wall or impinges on the meter box wall. The screw is accessed from inside the box using a screw driver, or other tool. Unfortunately, installing the bracket requires the user to reach into the box in close proximity to the electrical components which increases the risk of electrical shock to the use. Moreover, installing the mounting bracket is time consuming because of the necessity to install the screw.

A quick installation of the lock assembly is desirable in the case of the utility company disconnecting service for non-payment since in this case, the utility company employee is often not the most welcome of visitors and on occasion violence occurs. Therefore, a need exists for a meter box locking assembly that is quickly installed and does not expose a user to electrical components inside the meter box.

BRIEF SUMMARY OF THE INVENTION

The present invention provides a locking assembly for locking a cover over an opening of an enclosure. The assembly includes a mounting bracket including a first wall having opposing first and second ends, a second wall joined to said first end and extending in a first direction away from the first wall. A stud joined to the first wall extends in a second direction away from the first wall. Hooking structure extends from the second wall of the mounting bracket for extending into the opening of the enclosure and engaging the enclosure to secure the mounting bracket relative to the enclosure. A locking bracket includes a first wall having opposing first and second ends and a first surface facing the first wall of the mounting bracket. A second wall is joined to the first end of the mounting bracket and extends in a first direction away from the first wall of the locking bracket. In one embodiment, a lock housing is fixed to the first wall of the locking bracket. The lock housing defines a cavity for receiving a barrel lock and an opening intersecting said cavity. The opening receives the stud for engaging the barrel lock received in the cavity.

A general objective of the present invention is to provide a locking assembly that is quickly installed onto a meter box to lock a meter box cover over an opening in the meter box. The objective is accomplished by providing a locking assembly with hooking structure that engages the enclosure to secure the mounting bracket relative to the enclosure.

Another objective of the present invention is to provide a locking assembly that does not require a user to reach into the enclosure. This objective is accomplished by providing a locking assembly that does not require tools to secure the mounting bracket relative to the enclosure.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
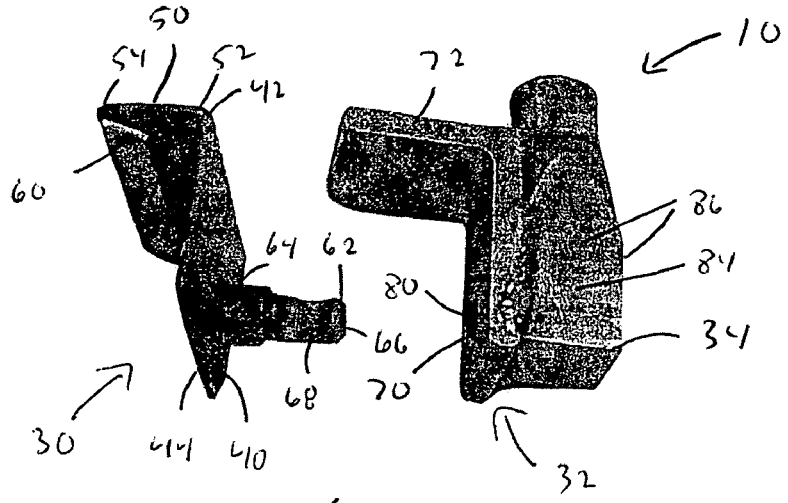
FIG. 1 is a perspective view of a locking assembly incorporating the present invention.
Figure 2:
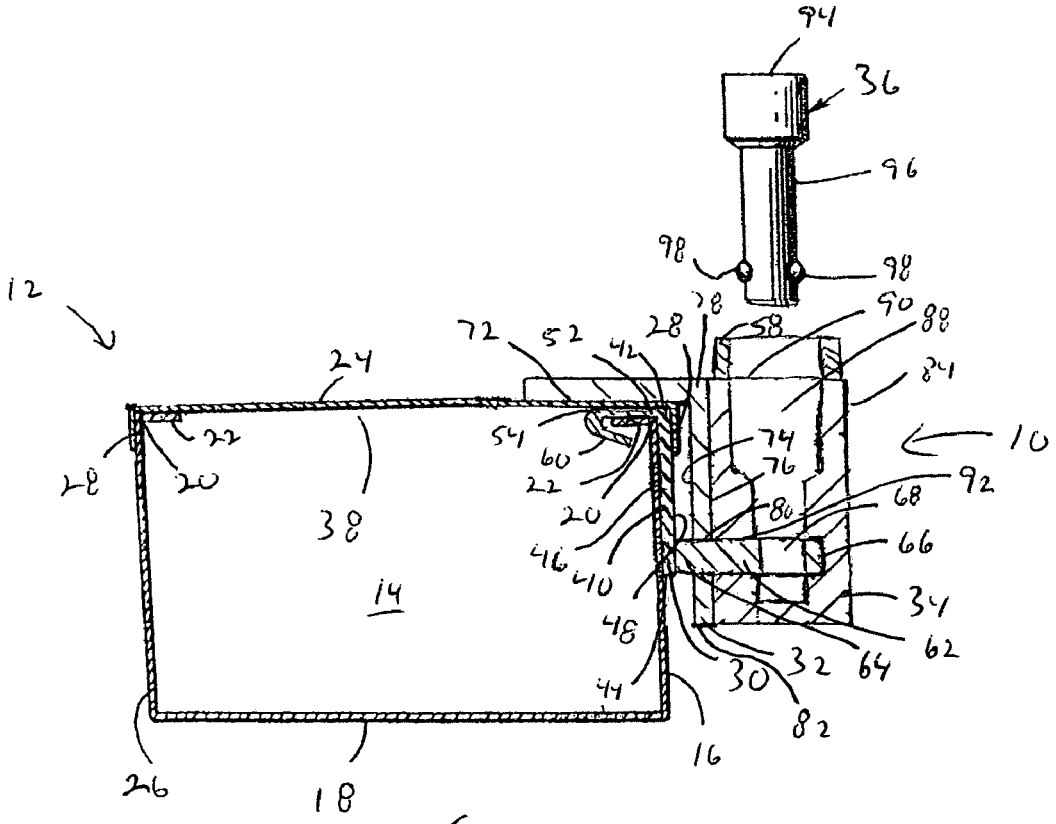
FIG. 2 is a cross sectional view of the locking assembly of FIG. 1 mounted on a meter box.
Figure 3:
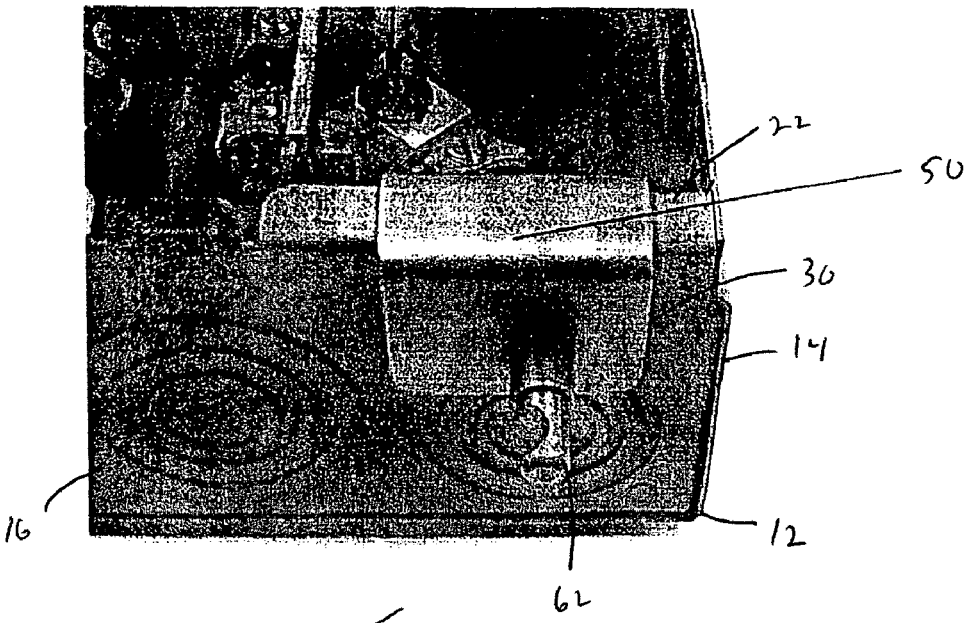
FIG. 3 is a perspective view of the mounting bracket of FIG. 1 mounted on a meter box.
Figure 4:
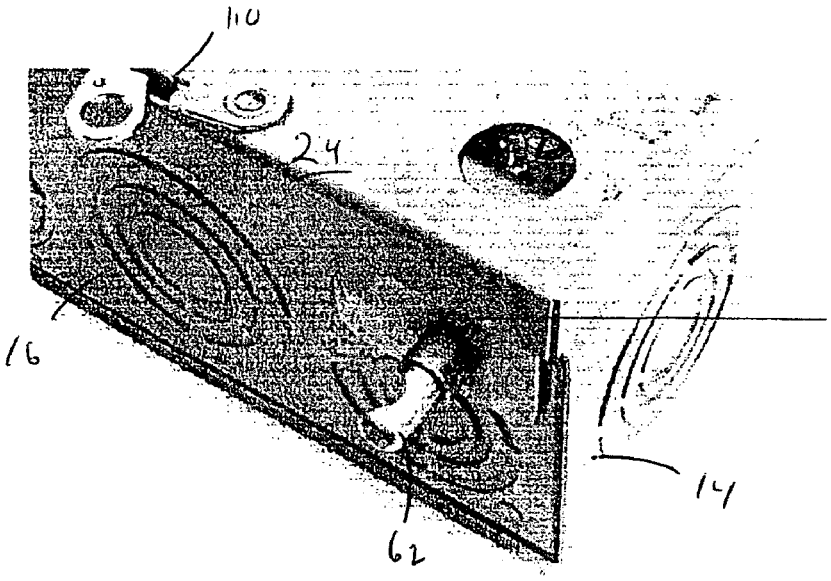
FIG. 4 is a perspective view of the meter box cover closed over the mounting bracket mounted on the meter box of FIG. 3.
Figure 5:
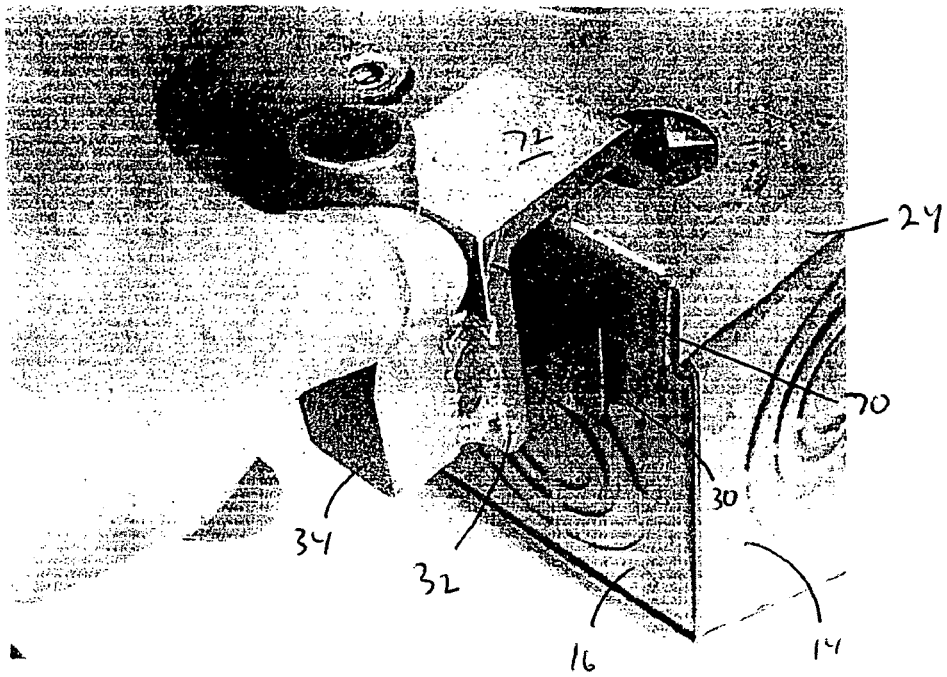
FIG. 5 is a perspective view of the locking bracket of FIG. 1 mated with the mounting bracket mounted on the meter box.
Figure 6:
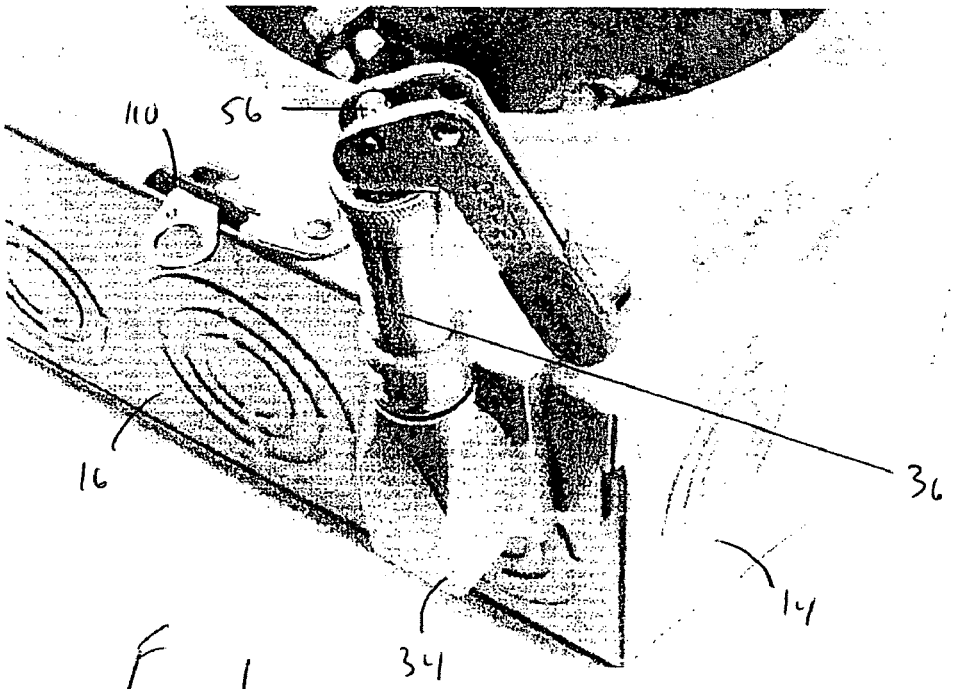
FIG. 6 is a perspective view of a barrel lock inserted into the lock housing fixed to the locking bracket of FIG. 5.
Figure 7:
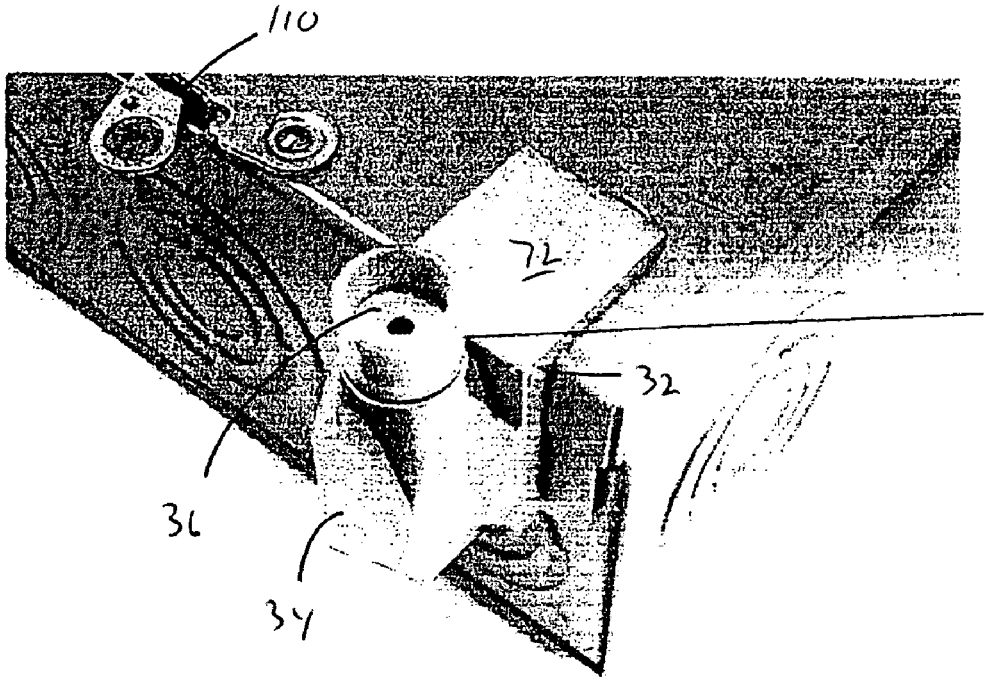
FIG. 7 is the meter box of FIG. 3 locked by the locking assembly.

The locking assembly 10 shown in FIG. 1-7 according to the invention herein is useful in maintaining an electric meter box 12, or other enclosure, in its closed condition, thereby protecting the enclosed electric meter or wiring connections from being tampered with to steal electricity. The electric meter box 12 is relatively standard, and with reference to FIGS. 2 and 3, includes side walls 14, a front wall 16, a back wall 26, and a bottom 18. Upper edges 20 of the walls 14, 16, 26 define an opening 38 into the box 12. Wall flanges 22 extend inwardly into the opening 38 from the upper edges 20 of the back and front walls 26, 16. The electric meter box 12 is provided with a cover 24 to cover the opening. The cover 24 can slip over the opening 38 or be hingedly mounted to the back wall 26 by means of a hinge. The cover 24 overlaps the wall flanges 22 and is typically provided with a lip 28 which fits partially over the front wall 16 and side walls 14 when the electric meter box 12 is closed.

The locking assembly 10 locks the cover 24 over the opening to prevent unauthorized access to the meter box contents. In the following description, the locking assembly 10 is mounted on the front wall 16 of the meter box 12. However, it is understood that the locking assembly 10 can be mounted on the side walls 14, front wall 16, and/or back wall 26 of the meter box 12 without departing from the scope of the invention.

Referring now to FIGS. 1-7, the locking assembly 10 includes a mounting bracket 30 that slips over the upper edge 20 of the meter box front wall 16 under the cover 24, a locking bracket 32 adjacent the mounting bracket 30 that slips over the cover 24, and a lock housing 34 fixed to the locking bracket 32 that receives a barrel lock 36 to lock the mounting and locking brackets 30, 32 together. Locking the mounting and locking brackets 30, 32 relative to each other prevents movement of the cover 24 to allow access into the meter box 12. Advantageously, the locking assembly 10 is quickly and easily installed onto the meter box 12 without the use of any tools or the need for holes formed in any of the meter box walls 14, 16.

The mounting bracket 30 is L-shaped having a first leg 40, or wall, with opposing longitudinal ends 42, 44. The first leg 40 includes an inner face 46 facing toward the meter box front wall 16 and an opposing outer face 48 facing away from the meter box front wall 16. A second leg 50 joined to one end 42 of the first leg 40 extends orthogonal to the first leg 40 over the upper edge 20 and wall flange 22 of the front wall 16 beneath the cover 24. The second leg 50 extends from a first end 52 joined to the one end 42 of the first leg 40 toward a second end 54.

In the embodiment disclosed in FIGS. 1-7, a third leg 60 joined to the second end 54 of the second leg 50 extends beneath the wall flange 22 to hook the mounting bracket 30 onto the wall flange 22 and secure the mounting bracket 30 relative to the meter box 12. Although hooking structure, such as the third leg 60 extending beneath the flange 22 is disclosed, other hooking structure that does not require tools to secure the mounting bracket 30 relative to the meter box 12, such as disclosed below can also be used without departing from the scope of the invention. Preferably, the three legs 40, 50, 60 of the mounting bracket 30 are formed from a single piece of case hardened steel. However, the mounting bracket 30 can be formed from any suitable material, such as metal, plastic, and the like. Most preferably, the first and second legs 40, 50 of the mounting bracket 30 have a thickness that allows the cover 24 to fully close, such that existing lock or seal mechanisms, such as shown at 110 in FIGS. 4, 6, and 7, can still be used.

A stud 62 fixed to the outer face 48 of the first leg 40 of the mounting bracket 30 extends orthogonal to the outer face 48, and includes a proximal end 64 fixed to the outer face 48 and a distal end 66. The proximal end 64 is fixed to the outer face 48 using methods known in the art, such as welding, fasteners, and the like. A slot 68 formed proximal the distal end 66 is transverse to a longitudinal axis of the stud 62 for engaging the barrel lock 36. Although a transverse slot 68 is disclosed, the stud 62 can include any structure, such as a transverse throughhole, for engaging the barrel lock 36 without departing from the scope of the invention.

The locking bracket 32 is also L-shaped, and includes first and second legs 70, 72, or walls. The first leg 70 of the locking bracket 32 includes an inner face 74 facing toward the meter box front wall 16 and an opposing outer face 76 facing away from the meter box front wall 16. The second leg 72 is joined to one end 78 of the first leg 70, and extends orthogonal to the first leg 70 over the cover 24 to sandwich the cover 24 between the second legs 50, 72 of the mounting and locking brackets 30, 32. A hole 80 formed through the first leg 70 of the locking bracket 32 receives the stud 62 which extends therethrough. Of course, the locking bracket first leg 70 can be formed short of the stud 62, such that the stud 62 extends past the first leg 70 of the locking bracket 32 beneath the other end 82 of the locking bracket first leg 70 without departing from the scope of the invention.

The lock housing 34 includes an elongated body 84 fixed to the outer face 76 of the locking bracket first leg 70 using methods known in the art such as welding, fasteners, and the like. The body 84 includes side walls 86 defining an elongated cylindrical cavity 88 opening to one end 90 of the body 84. An opening 92 formed in one of the side walls 86 intersects the cavity 88, and receives the distal end 66 of the stud 62 through the hole 80 formed in the locking bracket first leg 70. Preferably, the body 84 is formed from a case hardened material, such as steel. A seal mount 58 can be provided that is aligned with the cavity 88 for receiving a seal that provides evidence of tampering if an attempt is made to remove the barrel lock 36.

The barrel lock 36 is received in the cavity 88 through the body one end 90, and engages the stud 62, or lock housing 34, to lock the mounting and locking brackets 30, 32 relative to each other. As shown in FIG, 2, the barrel lock 36 includes a head 94, a shank 96, and expansible balls 98, or other extendible structure, operated by an internal plunger actuated by a key 56. Several manufacturers make such locks, and they have a standard outside configuration and size, although internal parts and key structures differ between manufacturers. The barrel lock can be any lock mechanism known in the art, that fits in the cavity, such as the barrel locks disclosed in U.S. Pat. Nos. 4,425,647 and 4,474,041, and which are fully incorporated herein by reference.

To mount the locking assembly 10 on the meter box 12 to lock the cover 24 over the meter box opening 38, the meter box cover 24 is opened and the mounting bracket 30 is hooked onto the meter box wall flange 22, such that the mounting bracket second leg 50 extends over the meter box wall flange 22 and the mounting bracket third leg 60 extends beneath the meter box wall flange 22 to hook the mounting bracket 30 onto the meter box front wall 16. The meter box cover 24 is then closed over the mounting bracket second leg 50, and the locking bracket 32 is positioned adjacent the mounting bracket 30, such that the locking bracket 32 extends over the cover 24 sandwiching the cover 24 between the second legs 50, 72 of the mounting and locking brackets 30, 32. The stud 62 is slipped into the opening 92 of the lock housing 34 through the hole 80 in the locking bracket 32. The barrel lock 36 is then slipped into the cavity 88 through the slot 68 formed in the stud 62, such that the extensible structure 98 of the barrel lock 36 slips past the stud 62.

The extensible structure 98 is then extended by means of the key, such that the extended extensible structure engages the stud 62 to prevent unauthorized removal of the barrel lock 36 from the cavity 88. Of course, in addition to, or instead of, engaging the extensible structure 98 with the stud 62, the extensible structure 98 can engage a groove or other retaining structure formed in the lock housing 34 to fix the barrel lock 36 relative to the lock housing and prevent unauthorized removal of the barrel lock 36 from the cavity 88, and thus lock the locking bracket 32 relative to the mounting bracket 30. Advantageously, installation of the locking assembly 10 is quick and easy. Moreover, the user never has to reach into the meter box 12 to tighten a screw to mount the locking assembly 10 onto the meter box 12 prior to locking the cover 24 over the meter box opening 38.

Figure 8:
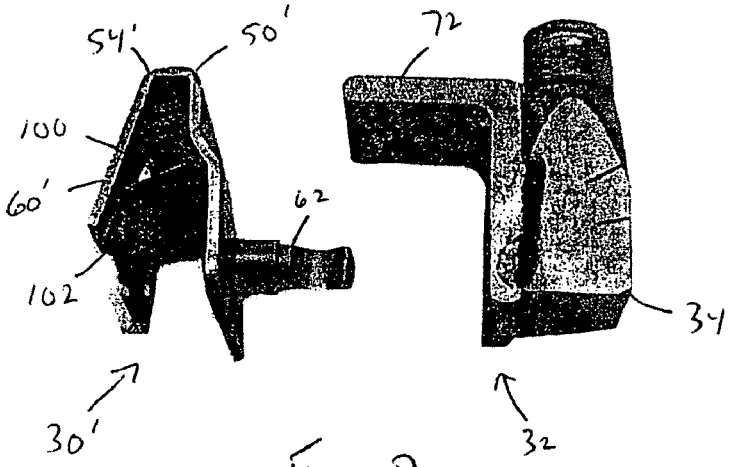
FIG. 8 is an alternative embodiment of a locking assembly incorporating the present invention.
Figure 9:
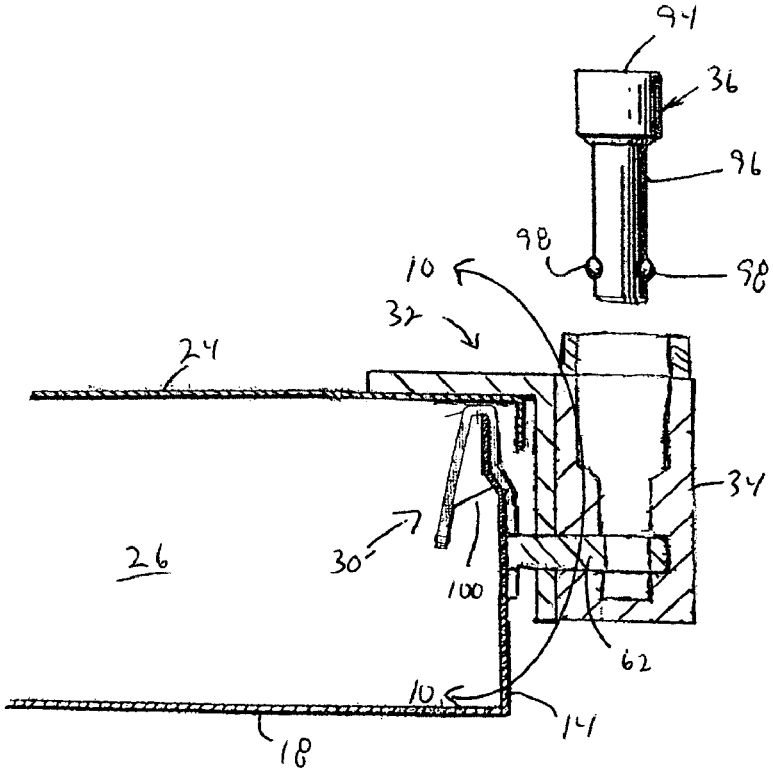
FIG. 9 is a cross sectional view of the locking assembly of FIG. 8 mounted on a meter box.
Figure 10:
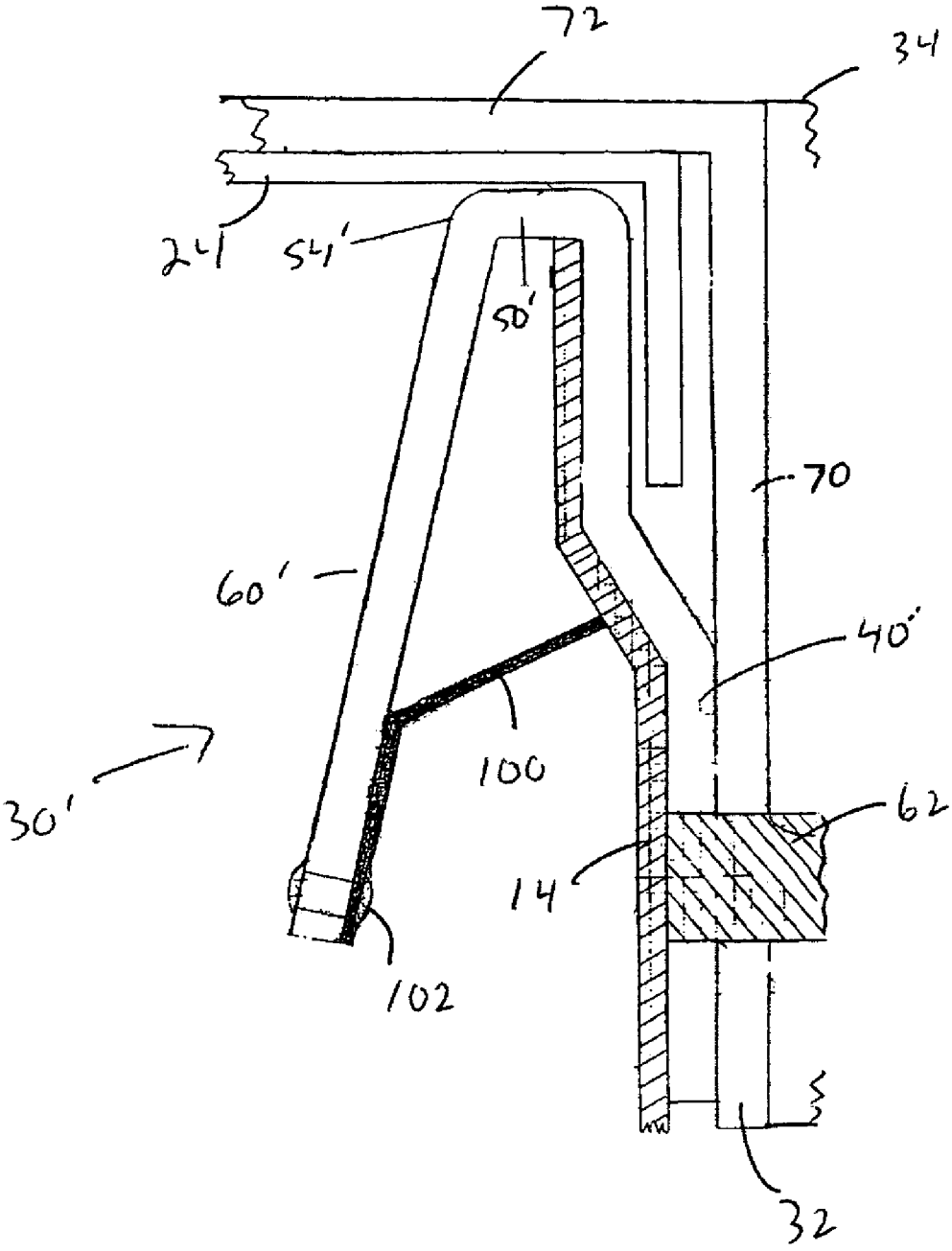
FIG. 10 is a detailed view along line 10-10 of FIG. 9.

In another embodiment shown in FIGS. 8-12, the mounting bracket 30' includes a first and second leg 40', 50' as described above, and is mounted on one of the side walls 14 of the meter box 12. The hooking structure that secures the mounting bracket 30' relative to the meter box 12 includes a third leg 60' joined to an end 54' of the second leg 50' and a spring clip 100. As shown in FIGS. 8-11, the first leg 40' can be shaped to conform to the meter box side wall 14. As in the first embodiment, the third leg 60' extends past the wall flange 22 into the meter box 12 through the meter box opening 38. Although the embodiment disclosed in FIG. 8, shows the third leg 60' extending away from the first leg 40' of the mounting bracket 30', the third leg 60' can extend toward, or parallel to, the mounting bracket first leg 40' without departing from the scope of the invention.

The spring clip 100 is fixed to the third leg 60', and extends toward the mounting bracket first leg 40'. The spring clip 100 is press fit onto studs 102 extending from the third leg 60' to fix the spring clip 100 to the third leg 60'. Of course, other methods for fixing the spring clip to the third leg can be used, such as welding, fasteners, and the like, without departing from the scope of the invention. Advantageously, the spring clip 100 is engageable with the meter box side wall 14, and any structure extending into the meter box 12 from the meter box side wall 14, to secure the mounting bracket 30' to the meter box 12. Although a spring clip formed from spring steel is preferred, any resilient material, such as metal, plastic, elastomeric material, and the like, can be used without departing from the scope of the invention.

Figure 11:
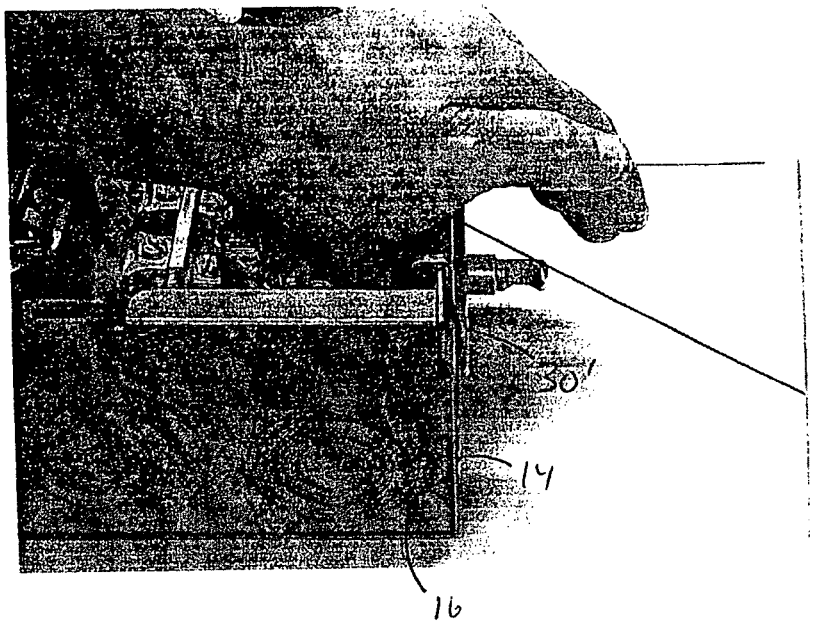
FIG. 11 is a perspective view of the mounting bracket of FIG. 8 being mounted on a meter box.
Figure 12:
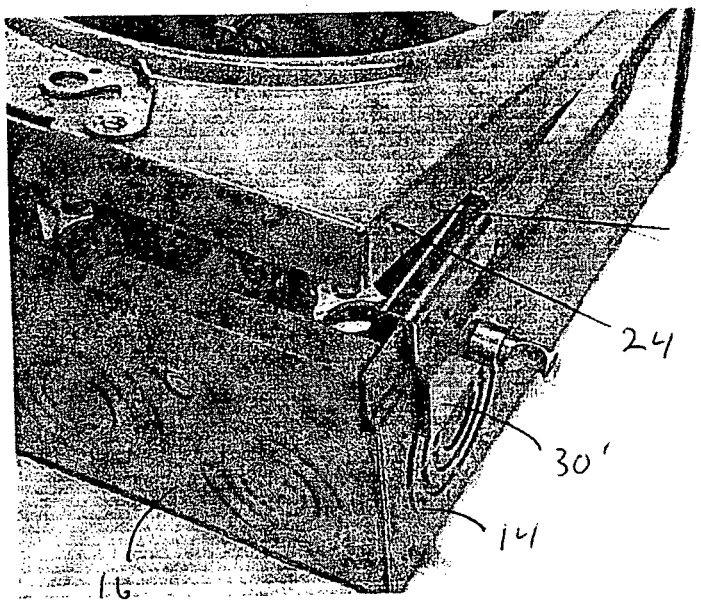
FIG. 12 is a perspective view of the meter box cover closing over the mounting bracket mounted on the meter box of FIG. 8.

The mounting bracket 30' of the second embodiment is secured to the meter box side wall 14 by positioning the upper edge 20 of the meter box side wall 14 between the first and third legs 40', 60' of the mounting bracket 30', and urging the mounting bracket 30', such as shown in FIG. 11, downwardly onto the side wall 14, such that the spring clip 100 deflects, or otherwise engages the side wall 14, to hook the mounting bracket 30' onto the meter box 12. The cover 24 is then closed, such as shown in FIG. 12, and the locking bracket 32 and barrel lock 36 are then positioned, as described above for the first embodiment.

While there have been shown and described what is at present considered the preferred embodiments of the invention, it will be obvious to those skilled in the art that various changes and modifications can be made therein without departing from the scope of the invention defined by the appended claims.

We claim:

1. A locking assembly for locking a cover over an opening of an enclosure, said assembly comprising:

a mounting bracket including a first wall having opposing first and second ends, a second wall joined to said first wall first end and extending in a first direction away from said first wall, and a stud joined to said first wall and extending in a second direction away from said first wall for engagement with a lock mechanism;

hooking structure extending from said second wall of said mounting bracket, said hooking structure engaging an inner wall of the enclosure to secure the mounting bracket relative to the enclosure;

a locking bracket including a first wall having opposing first and second ends and a first surface facing said first wall of said mounting bracket, a second wall joined to said first end of said locking bracket and extending in a first direction away from said first wall of said locking bracket;

a lock housing fixed to said first wall of said locking bracket, and defining a cavity for receiving a lock mechanism and an opening intersecting said cavity, said opening receiving said stud for engaging a barrel lock received in the cavity; and wherein said second wall of said mounting bracket includes a first end joined to said first end of said first wall of said mounting bracket and an opposing second end, and said hooking structure includes a resilient clip extending toward said first wall of said mounting bracket, said resilient clip engaging a wall of the enclosure to secure the mounting bracket relative to the enclosure.

2. The locking assembly as in claim 1, in which said hooking structure includes a third wall joined to said second end of said second wall of said mounting bracket, said third wall extending toward said first wall of said mounting bracket to wrap around and hook a flange extending from an upper edge of a wall forming an edge of an opening of the enclosure to secure the mounting bracket relative to the enclosure.

3. The locking assembly as in claim 1, including a lock mechanism in the form of a barrel lock received in said cavity and engaging said stud.

4. The locking assembly as in claim 1, in which a hole formed through said first wall of said locking bracket is aligned with said opening formed in said lock housing, and said stud is received in said opening formed in said lock housing through said hole.

5. The locking assembly as in claim 1, in which said lock housing is case hardened.

6. The locking assembly as in claim 1, in which a seal mount is fixed relative to said lock housing and aligned with said cavity for receiving a seal to provide evidence of tampering with a lock barrel received in said cavity.

7. A method of locking an enclosure having at least one wall defining an opening that is closed by a cover; said method comprising:

hooking a mounting bracket onto the wall of the enclosure and engaging a hooking structure forming part of the mounting bracket with the wall of the enclosure to secure the mounting bracket relative to the enclosure without the use of tools, wherein said hooking structure includes a resilient clip extending toward said first wall of said mounting bracket and engaging the wall of the enclosure to secure the mounting bracket relative to the enclosure;

closing the cover of the enclosure over the opening and at portion of the mounting bracket;

engaging a locking bracket with the mounting bracket, wherein a portion of the mounting bracket extends over the cover;

locking the locking bracket relative to the mounting bracket to prevent unauthorized opening of the cover.

8. The method as in claim 7, in which said mounting bracket includes a first wall having opposing first and second ends, a second wall joined to said first wall first end and extending in a first direction away from said first wall toward a second wall second end, and said hooking structure extends from said second wall of said mounting bracket into the opening of the enclosure and engages the enclosure to secure the mounting bracket relative to the enclosure.

9. The method as in claim 7, in which said hooking structure includes a third wall joined to said second end of said second wall of said mounting bracket, said third wall extending toward said first wall of said mounting bracket to wrap around and hook a flange extending from an upper edge of a wall forming an edge of an opening of the enclosure.

10. The method as in claim 7, in which said mounting bracket and locking bracket are locked relative to each other by a lock mechanism.

11. The method as in claim 7, in which said mounting bracket includes a stud received in a lock housing fixed to said locking bracket, and locking the locking bracket relative to the mounting bracket includes inserting a lock mechanism into said lock housing to lock the locking bracket relative to the mounting bracket.

12. A locking assembly for locking a cover over an opening of an enclosure, said assembly comprising:

a mounting bracket including a first wall having opposing first and second ends, a second wall joined to said first wall first end and extending in a first direction away from said first wall, and a stud joined to said first wall and extending in a second direction away from said first wall for engagement with a lock mechanism;

hooking structure extending from said second wall of said mounting bracket for extending into the opening of the enclosure and engaging the enclosure to secure the mounting bracket relative to the enclosure;

a locking bracket including a first wall having opposing first and second ends and a first surface facing said first wall of said mounting bracket, a second wall joined to said first end of said locking bracket and extending in a first direction away from said first wall of said locking bracket, and a hole formed through said first wall, wherein said stud extends through said first wall; and wherein said second wall of said mounting bracket includes a first end joined to said first end of said first wall of said mounting bracket and an opposing second end, and said hooking structure includes a resilient clip extending toward said first wall of said mounting bracket, said resilient clip engaging said enclosure to secure the mounting bracket relative to the enclosure.

13. The locking assembly as in claim 12, in which said second wall of said mounting bracket includes a first end joined to said first end of said first wall of said mounting bracket and an opposing second end, and said hooking structure includes a third wall joined to said second end of said second wall of said mounting bracket, said third wall extending toward said first wall of said mounting bracket to wrap around and hook a flange extending from an upper edge of a wall forming an edge of an opening of the enclosure to secure the mounting bracket relative to the enclosure.

14. The locking assembly as in claim 12, including a lock housing fixed to said first wall of said locking bracket, and defining a cavity for receiving a lock mechanism and an opening aligned with said hole and intersecting said cavity, said opening receiving said stud through said hole for engaging a barrel lock received in the cavity.

15. The locking assembly as in claim 14, including a lock mechanism in the form of a barrel lock received in said cavity and engaging said stud.

16. The locking assembly as in claim 14, in which a hole formed through said first wall of said locking bracket is aligned with said opening formed in said lock housing, and said stud is received in said opening formed in said lock housing through said hole.

17. The locking assembly as in claim 14, in which said lock housing is case hardened.

18. The locking assembly as in claim 14, in which a seal mount is fixed relative to said lock housing and aligned with said cavity for receiving a seal to provide evidence of tampering with a lock barrel received in said cavity.

* * * * *